US005198833A

United States Patent [19]

Kubota

[11] Patent Number: 5,198,833

[45] Date of Patent: Mar. 30, 1993

[54] VARIABLE DENSITY INK-JET DOT PRINTER

[75] Inventor: Hiroshi Kubota, Yamatotakada, Japan

[73] Assignee: Sharp Kabushiki Kaisha, Osaka, Japan

[21] Appl. No.: 542,791

[22] Filed: Jun. 25, 1990

Related U.S. Application Data

[63] Continuation of Ser. No. 265,918, Nov. 2, 1988, abandoned.

[30] Foreign Application Priority Data

Nov. 4, 1987 [JP] Japan ..... 62-280144

[51] Int. Cl.[5] ..... B41J 2/205

[52] U.S. Cl. ..... 346/1.1; 346/140 R; 400/126

[58] Field of Search ..... 400/120, 126; 346/140 PD, 140 R, 1.1

[56] References Cited

U.S. PATENT DOCUMENTS

| | | | |
|---|---|---|---|
| 3,968,498 | 7/1976 | Uchiyama | 346/140 PD |
| 4,189,734 | 2/1980 | Kyser | 346/140 PD |
| 4,216,480 | 8/1980 | Buehner | 400/126 |
| 4,284,362 | 8/1981 | Jackson | 400/124 |
| 4,344,079 | 8/1982 | Chambors | 346/140 PD |
| 4,521,786 | 6/1985 | Bain | 346/140 PD |
| 4,542,384 | 9/1985 | Tazaki | 400/126 |
| 4,561,025 | 12/1985 | Tsuzuki | 346/140 R |
| 4,679,053 | 7/1987 | Katsurai | 400/120 |
| 4,712,930 | 12/1987 | Maruno | 400/120 |
| 4,743,924 | 5/1988 | Scardovi | 400/126 |
| 4,809,021 | 2/1989 | Check | 346/108 |

FOREIGN PATENT DOCUMENTS

| | | | |
|---|---|---|---|
| 0101862 | 7/1983 | European Pat. Off. | 400/126 |
| 58-16857A | 1/1983 | Japan | 400/126 |

*Primary Examiner*—David A. Wiecking
*Assistant Examiner*—Steven S. Kelley

[57] ABSTRACT

A dot printer is disclosed for effecting printing by ejecting ink in dots such that under a normal print speed mode, in which the dot density is high, a standard amount of ink is ejected per dot. Under a high print speed mode, or draft mode, in which the dot density is low, a greater amount of ink is ejected per dot.

4 Claims, 2 Drawing Sheets

VARIABLE DENSITY INK-JET DOT PRINTER

This application is a continuation of application Ser. No. 07/265,918 filed on Nov. 2, 1988, now abandoned.

BACKGROUND OF THE INVENTION

1. Field of the Invention

The present invention relates to a dot printing system preferably for used in an ink-jet printer or the like in which printing is effected not only in a mode for performing normal printing, but also in a mode for effecting high speed printing, a so-called draft mode, using a reduced number of dots.

2. Description of the Prior Art

Conventionally, an ink-jet printer is provided with a so-called draft mode under which the number of dots of the ejection ink from a nozzle is reduced, for example, to half the number of dots used to make a character pattern under the normal mode.

Printing can be performed at high speed, though the printed pattern is coarse, under the draft mode of such an ink-jet printer. Accordingly, printing under the draft mode is selected when it is desired to have quick printing wherein a reduction in print quality can be tolerated such that the printed patterns have low resolution and insufficient darkness.

In other words, according to the above-described known art, since printing is effected using a reduced number of dots under the draft mode, the amount of ink to be ejected per area of a sheet of paper on which patterns are printed is smaller in the draft mode than in the normal mode. Accordingly, the densities or the darkness of the patterns printed in the draft mode are reduced. As a result, the pattern of the character or picture image printed under the draft mode is poor when compared with that printed under the normal mode.

SUMMARY OF THE INVENTION

The present invention has been developed with a view to substantially solving the above described disadvantages and has for its essential object to provide an improved dot printing system which can provide a sufficiently dark image even under the draft mode, thereby improving the quality of patterns even when using a reduced number of dots.

In accomplishing these and other objects, the printing system according to the present invention is characterized in that the amount of ink to be ejected per dot is increased under the draft mode so that the pattern defined by a plurality of dots has a sufficient darkness.

In operation, when printing a pattern under the draft mode, i.e., at a high speed mode using a reduced number of dots, if the amount of ink to be consumed per dot is the same as that to be consumed under the normal printing mode, the amount of ink to be ejected onto a sheet of paper using a reduced number of dots is less than that to be ejected onto the sheet of paper in normal printing. Therefore, the density or the darkness of a pattern printed on the sheet of paper is reduced. However, according to the present invention, when printing is effected using a reduced number of dots, ink is ejected at an increased amount. Accordingly, even when a smaller number of dots are used under the draft mode, patterns can be printed at high speed without reducing the densities thereof.

BRIEF DESCRIPTION OF THE DRAWINGS

These and other objects and features of the present invention will become apparent from the following description taken in conjunction with a preferred embodiment thereof with reference to the accompanying drawings, which are given by way of illustration only, and thus are not limitative of the present invention, throughout which like parts are designated by like reference numerals, and in which.

DETAILED DESCRIPTION OF THE PREFERRED EMBODIMENTS

Figure 1:
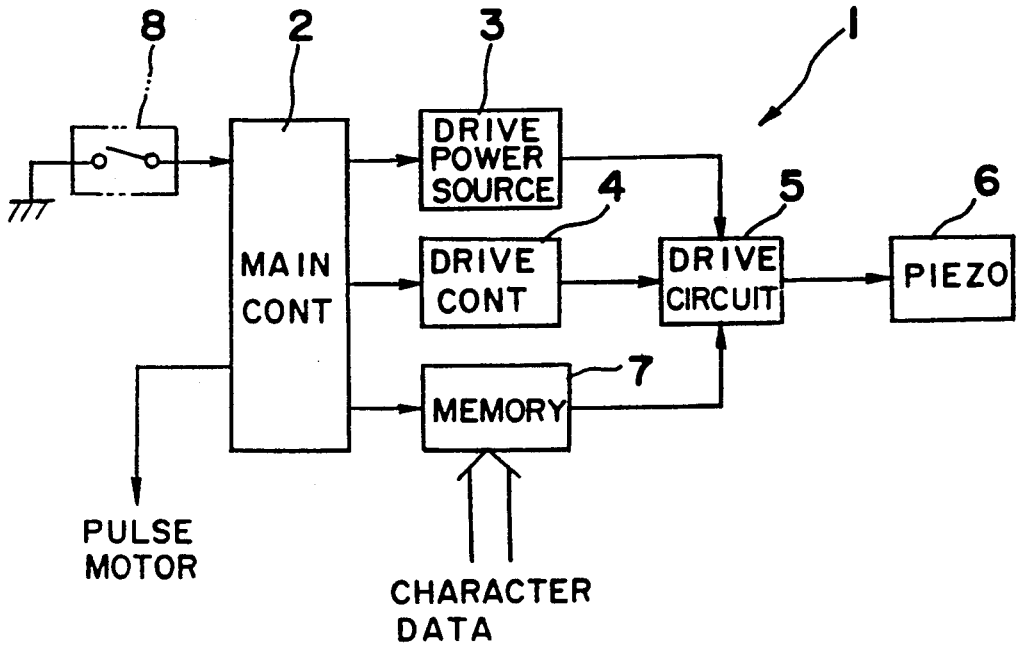
FIG. 1 is a block diagram of an ink-jet printer according to one embodiment of the present invention.

Referring to FIG. 1, a block diagram of an ink-jet printer 1 according to the present invention is shown. The ink-jet printer 1 comprises a mode selection switch 8, a main control 2, a drive power source 3, a drive control 4, a drive circuit 5, and a piezoelectric device 6.

The mode selection switch 8 is connected to the main control 2 and the main control 2 controls selection of the mode between that of a normal mode (or a fine mode) and a draft mode, or vice versa, according to the condition of the mode selection switch 8.

The main control 2 controls various elements, such as the pulse motor, printing data inputted to and outputted from a memory 7, the drive pulse signal of the drive control 4, and the drive power source 3. Drive circuit 5 receives power from power source 3, the drive pulse signal from drive control 4, and the printing data from the memory 7. The piezoelectric device 6 is driven by the output signal from the drive circuit 5 so as to apply pressure to ink. As a result, the ink is ejected from a nozzle (not shown) to effect printing.

Figure 2:
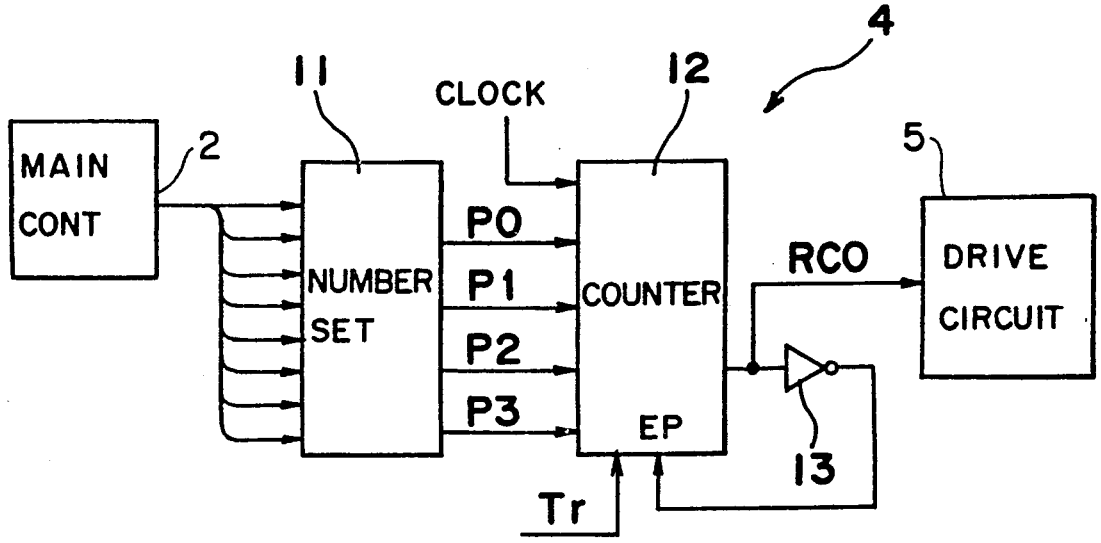
FIG. 2 is a block diagram of the drive control circuit 4 shown in FIG. 1.

Referring to FIG. 2, a block diagram of the drive control 4 is shown. The drive control 4 comprises a number setting circuit 11 and a counter 12 which are provided for changing the pulse width of the drive pulse signal according to the control signal supplied from the main control 2.

The signal applied from the main control 2 to the number setting circuit 11 under the fine, or normal, mode differs from that applied under the draft mode as described below. The number setting circuit 11 outputs parallel signals P0, P1, P2 and P3 of, for example, a four bit signal representing a number N to the counter 12 in response to these control signals. Simultaneously with the step down of a trigger signal Tr (FIG. 3 waveform (3)), the parallel signals P0, P1, P2 and P3 representing a value N are applied to the counter 12 as the initial counting value from which the count-up operation starts. Then, in response to clock signals, the counter 12 counts up starting from the value N until the maximum amount which the counter 12 can count, such as 15.

A signal RCO generated from the counter 12 becomes low in response to the step down of the trigger signal Tr and becomes high when the counter 12 has counted up to the maximum, i.e., to 15. The signal RCO is applied to drive circuit 5 and also to a terminal EP of the counter 12 through an inverter 13. When counter 12 counts up to the maximum, i.e., 15, the signal RCO becomes high and is held high thereafter, and the signal applied to the terminal EP becomes low and is held low thereafter. During the period in which the signal RCO is maintained low, drive circuit 5 drives the piezoelectric device 6 so as to apply pressure to the ink to effect ink ejection from the nozzle.

According to the present invention, the initial value N produced from number setting circuit 11 under the fine mode is greater than that produced under the draft mode. For example, under the fine mode, the initial value N as defined by signals P0, P1, P2 and P3 is assumed to be 10, and under the draft mode, the same is assumed to be 4.

Figure 3:
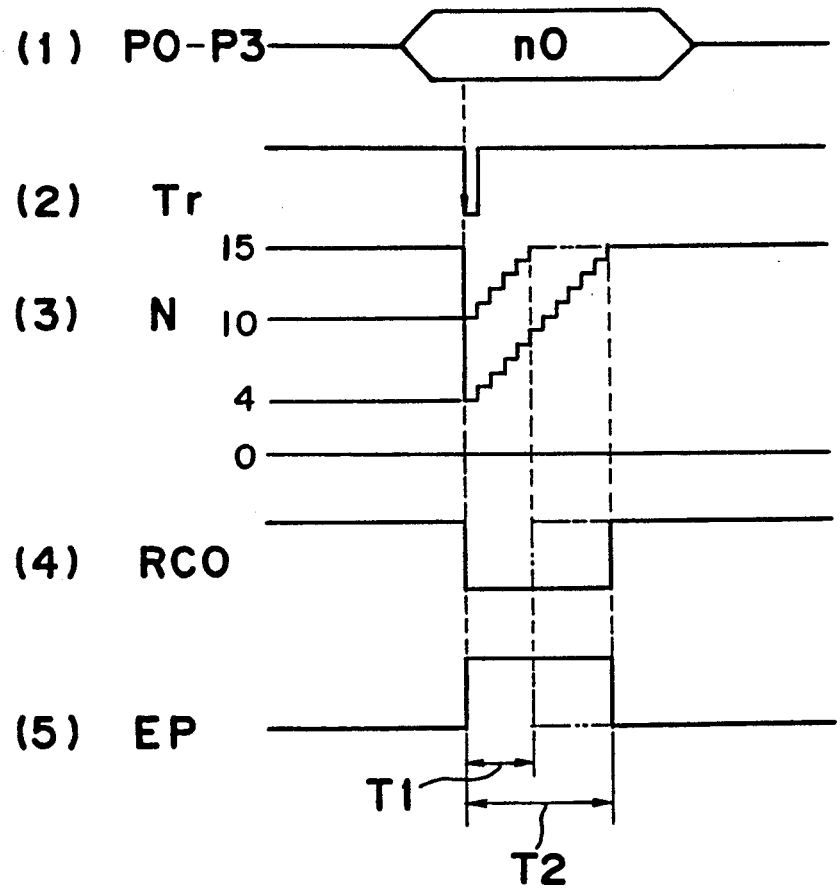
FIG. 3 is a time chart showing an operation of the drive control circuit 4 of FIG. 2.

In FIG. 3, the operation under the fine mode is shown by two-dot chain lines, and the operation under the draft mode is shown by solid lines. Simultaneously with the step down of the trigger signal Tr (FIG. 3 waveform (2)), the parallel signals P0, P1, P2 and P3 are applied to the counter 12. The counter 12 starts count up from value 10 under the fine mode, and from 4 under the draft mode. Since the count up continues until the counter has counted up to 15, the counter 12 continues to count during a period T1 under the fine mode, and during a period T2 under the draft mode (FIG. 3, waveform (5)). During the counting operation, the signal RCO is maintained low. Thus, under the fine mode, the signal RCO is maintained low for period T1, and under the draft mode, the signal RCO is maintained low for period T2, which is longer than T1. During the period T1 or T2, the piezoelectric device 6 is operated so that ink is ejected from the nozzle.

As understood from the above, under the draft mode, since the piezoelectric device 6 is driven during the period T2 which is longer than the period T1, a greater amount of ink is ejected from the nozzle than that under the fine mode.

Thus, under the draft mode, although a less number of dots are used, for example, every other dot of the dots used under the fine mode are used and a greater amount of ink is used in each dot to depict a character. Accordingly, the darkness of the character printed under the draft mode can be maintained as dark as that obtained under the fine mode. Thus, the printing quality can be improved.

Figure 4:
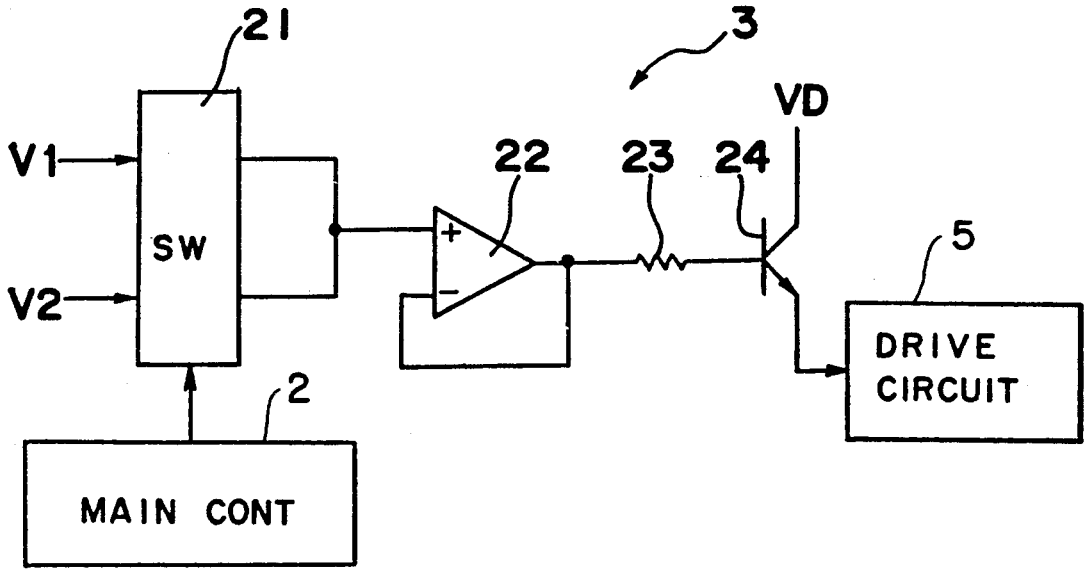
FIG. 4 is a block diagram of the drive power source circuit 3 shown in FIG. 1.

Referring to FIG. 4 an example of a block diagram of the drive power source 3 of the ink-jet printer 1 is shown. The drive power source 3 comprises a switching circuit 21, a differential amplifier 22, and a transistor 24.

Voltages V1 and V2 having different levels are applied to the switching circuit 21. Depending on the level of the signal supplied from the main control 2, the switching circuit 21 applies either voltage V1 or voltage V2 to the non-inverting input terminal of the differential amplifier 22. Under the fine mode, the voltage V1 is applied, and under the draft mode, the voltage V2 under is applied. The output of the differential amplifier 22 is applied to the inverting input of the differential amplifier as negative feedback negative fedback so that the internal impedance of the input side thereof is great, thus enabling the differential amplifier 22 to function as a buffer. The output of the differential amplifier 22 is also applied to the transistor 24 through a resistor 23 so that, by the source voltage VD, an amplified output is applied to the drive circuit 5.

Since the electric power supplied from the switching circuit 21 to the drive circuit 5 differs according to the selected voltage V1 or V2, the voltage level of the signal produced from the drive circuit 5 changes. For example, if $V1<V2$, the drive power as produced from drive circuit 5 and applied to the piezoelectric device 6 under the draft mode is greater than that applied under the fine mode.

Therefore, the ink ejected under the draft mode is ejected with a stronger pressure than that under the fine mode, resulting such that the amount of ink ejected under the draft mode is greater than that under the fine mode.

Thus, in a similar manner described above, the quality of printed characters can be improved under the draft mode.

The description has been made hereinabove with respect to the circuit of FIG. 2 for changing the pulse width of the drive pulse signal by means of the drive control circuit 4 or with respect to the circuit of FIG. 4 for changing the pulse voltage level of the drive pulse signal by means of the drive power source circuit 3. According to the present invention, the circuits of FIGS. 2 and 4 can be adopted simultaneously to obtain a favorable efficiency, or alternatively, either one of the circuits can be employed to control the amount of ink under two different modes.

Furthermore, instead of two modes, the present invention can be applied to a printer which can print under three or more modes while maintaining the same ink darkness quality between the different modes. This can be accomplished, in the case of FIG. 2, by providing three or more different initial values N, and in the case of FIG. 4, by providing three of more different voltages V1, V2, V3, . . . .

As described above, according to the present invention, the amount of ink ejected from the nozzle can be increased when printing is performed with a reduced number of dots. Accordingly, in spite of the reduction of the number of dots, the total amount of ink ejected from the nozzle is maintained constant, thus preventing the reduction of the density of the printed character, thereby improving the quality of the printed character.

Although the present invention has been fully described in connection with the a preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An ink-jet dot printer for printing an image with a plurality of dots such that under a first mode the image is formed by a first density of dots and under a second mode the image is formed by a second density, which is lower than the first density of dots, said printer comprising:

switch means for selectively switching between said first and second modes;

time setting means for setting a first time period when said first mode is selected and for setting a second time period, longer than said first time period, when said second mode is selected, said time setting means comprising number setting means, responsive to said switch means, for outputting an initial count value, and counting means, coupled to said number setting means, for counting up from said initial count value to a predetermined count value in order to generate timing signals indicative of said first and second time periods, said initial count value being smaller for said second mode than for said first mode;

voltage setting means for generating a first voltage when said first mode is selected and for generating a second voltage, greater than said first voltage, when said second mode is selected; and driving means, coupled to said time setting means and said voltage setting means, for providing a pressure to ink, in accordance with drive pulses, during said first mode, which are of duration equal to said first time period and are of said first voltage, and in accordance with drive pulses during said second mode which are of duration equal to said second time period and are of said second voltage, so that ink ejected from the ink-jet dot printer used for depicting a dot is greater in amount under said second mode than that under said first mode in order to control dot size.

2. An ink-jet dot printer for printing an image with a plurality of dots such that under a first mode the image is formed by a first density of dots and under a second mode the image is formed by a second density, which is lower than the first density of dots, said printer comprising:

switch means for selectively switching between said first and second modes;

voltage setting means for generating a first voltage when said first mode is selected and for generating a second voltage, greater than said first voltage, when said second mode is selected;

time setting means, for setting a first time period when said first mode is selected and a second time period, longer than said first time period, when said second mode is selected and for generating timing signals indicative of said first and second time periods; and driving means, coupled to said time setting means and said voltage setting means, for providing a first pressure to ink in accordance with first pulses of said first voltage and duration equal to said first time period, during said first mode and for providing a second pressure to ink in accordance with second pulses of said second voltage and duration equal to said second time period, during said second mode so that ink ejected from the ink-jet dot printer used for depicting a dot is greater in amount under said second mode than that under said first mode, to control dot size.

3. The ink-jet dot printer of claim 2, wherein said time setting means comprises:

number setting means, responsive to said switch means, for outputting an initial count value; and counting means, coupled to said number setting means, for counting up from said initial count value to a predetermined count value, in order to set said time periods and generate said timing signals, said initial count value being smaller for said second mode than for said first mode.

4. A method of increasing dot density in ink-jet dot printing such that under a first mode an image is formed by a first density of dots and under a second mode the image is formed by a second density, which is lower than the first density of dots, the method comprising the steps of:

switching selectively between the first and second modes;

setting a first time period in response to selection of the first mode and setting a second time period, longer than the first time period, and generating timing signals indicative of the first and second time period, in response to selection of the second mode by setting initial count values for each of the first and second modes and by counting up to a predetermined count number from the initial count values, in the time setting means;

generating, in voltage setting means, a first voltage in response to selection of the first mode and a second voltage, greater than the first voltage, in response to selection of the second mode; and generating, in drive means, first drive pulses of the first voltage and of duration equal to the first time period to apply a first pressure to ink during the first mode and generating second drive pulses of the second voltage and of duration equal to the second time period to apply a second pressure to ink during the second mode so that ink ejected from an ink-jet dot printer used for depicting a dot is greater in amount under the second mode than that under the first mode to thereby increase dot density during the second mode to control dot size.

* * * * *